US006878071B1

(12) United States Patent
Schwieger et al.

(10) Patent No.: US 6,878,071 B1
(45) Date of Patent: Apr. 12, 2005

(54) GOLF CLUB WITH BALL RETRIEVAL AND TEE PLACEMENT

(76) Inventors: Gerald R. Schwieger, 401 S. County Rd. 5 #115, Springfield, Brown, MN (US) 56087; James T. Schwieger, 410 N. 1st Ave. West, Truman, Martin, MN (US) 56088

( * ) Notice: Subject to any disclaimer, the term of this patent is extended or adjusted under 35 U.S.C. 154(b) by 29 days.

(21) Appl. No.: 10/463,454

(22) Filed: Jun. 16, 2003

Related U.S. Application Data

(60) Provisional application No. 60/388,860, filed on Jun. 17, 2002, and provisional application No. 60/391,829, filed on Jun. 28, 2002.

(51) Int. Cl.[7] ..... A63B 53/04

(52) U.S. Cl. ..... 473/284; 473/286; 473/340; 294/19.2

(58) Field of Search ..... 473/284, 286, 473/340–341, 313; 294/19.2

(56) References Cited

U.S. PATENT DOCUMENTS

| | | | | |
|---|---|---|---|---|
| 1,634,652 | A | | 7/1927 | Czichos |
| 2,213,190 | A | | 9/1940 | Haverbach |
| 2,561,815 | A | | 7/1951 | Oberg |
| 2,802,687 | A | | 8/1957 | Du Chene |
| 3,300,241 | A | | 1/1967 | Eberwein et al. |
| 3,401,970 | A | | 9/1968 | Russel |
| D217,483 | S | | 5/1970 | Jackson |
| 3,632,112 | A | | 1/1972 | Jacobs |
| 3,944,231 | A | | 3/1976 | Johnson |
| 4,248,430 | A | | 2/1981 | Kepler |
| 4,580,784 | A | | 4/1986 | Brill |
| 4,934,702 | A | | 6/1990 | Serizawa |
| 5,102,139 | A | | 4/1992 | Greig |
| 5,299,846 | A | | 4/1994 | Rush |
| 5,368,302 | A | | 11/1994 | Thomas |
| 5,485,999 | A | | 1/1996 | Hull et al. |
| 5,692,968 | A | | 12/1997 | Shine |
| 5,759,117 | A | | 6/1998 | Erickson, Jr. |
| 5,772,533 | A | * | 6/1998 | Dahlmann ..... 473/386 |
| 6,159,108 | A | | 12/2000 | de la Pena |
| 6,379,259 | B1 | | 4/2002 | Opie |

* cited by examiner

*Primary Examiner*—Stephen Blau
(74) *Attorney, Agent, or Firm*—Albert W. Watkins

(57) ABSTRACT

A golf club head has tee handling and ball retrieval included therein. The tee handling includes an opening for receiving a tee head and having a roof coupled to a club shaft coupler, so that a golfer pressing upon the shaft may apply force through the golf club head to drive the tee into the earth. A partially open ring receives a tee shaft therein, but is sized to prevent a tee head from passing there through, so that a golf tee may be picked up and held therein. The tee may be picked up either when laying upon the ground or when already inserted into the earth. Ball retrieval is achieved by slightly cup-shaped relatively planar arms that form a semi-circular opening therebetween, into which a golf ball will nest and be retained by gravitational forces. A golf ball striking surface is additionally provided, which may be shaped to either serve as a putter, driver, or other suitable club.

17 Claims, 2 Drawing Sheets

GOLF CLUB WITH BALL RETRIEVAL AND TEE PLACEMENT

CROSS REFERENCE TO RELATED APPLICATIONS

This application claims priority to U.S. provisional applications Ser. No. 60/388,860 filed Jun. 17, 2002; and Ser. No. 60/391,829 filed Jun. 28, 2002, the contents of each which are herein incorporated by reference in entirety.

BACKGROUND OF THE INVENTION

1. Field of the Invention

This invention pertains generally to golf clubs, and more particularly to a club head with tee setting and ball retrieval features provided thereon.

2. Description of the Related Art

Golf is a very popular sport and past-time which provides exercise and entertainment for millions of participants. As is well known, in golf a player will start at the beginning of the course, commonly referred to as the "first hole", and will place a tee into the ground. On top of this tee a ball is placed, and then the golfer will strike the ball, to drive it as close as possible to a hole or ball cup. The hole is completed when the golfer strikes the ball into the hole, whether this is the first or some subsequent stroke.

A full round of golf will usually consist of either nine or eighteen holes of golf, depending upon the course. With a nine-hole course, the golfer will have to set the tee a minimum of nine times, and will have to retrieve the ball from the hole nine times as well. For a normal, healthy person, these eighteen times of bending down and reaching to ground or cup level is not considered to be burdensome, and is instead frequently considered to be a beneficial part of the total exercise provided by the sport.

Unfortunately, not all golfers are typical, and many have one or other physical challenges that may make golfing using traditional equipment difficult or impossible. One example is a back condition, wherein the golfer is not readily able to bend down sufficiently to reach ground level. A weak, injured or previously injured back may not be able to perform the necessary motions. Other persons with physical challenges or disabilities may likewise be unable to complete the necessary reaching to ground level. Similarly, as persons become older or where past injuries may exist, the requisite bending may be undesirable and uncomfortable.

A number of patents have attempted to reduce the amount or quantity of bending required during golfing, which will in turn both permit a golfer to continue golfing to a later age in one's life, and will also generally make the sport more enjoyable for many people. Exemplary patents, the contents of each which are incorporated herein by reference, include U.S. Pat. No. 4,248,430 to Kepler, which illustrates a putter having ball pickup and a ball marker setter and pickup feature; and U.S. Pat. No. 3,944,231 to Johnson, disclosing a club head to pick up a ball or a hole-flag. Unfortunately, in the case of both Johnson and Kepler, only ball pick-up has been addressed, even though Johnson explicitly was aware of the need to stoop at the tee. Czichos, in U.S. Pat. No. 1,634,652, the contents which are incorporated herein by reference, illustrates a tee setting device which is incorporated into the shaft of a club. Several alternative approaches for securing the tee therein are illustrated. Unfortunately, this shaft approach requires that the club be flipped upside down, and the handle exposed to the earth. Cleansing and handling thereof can be somewhat messy and undesirable.

Other additional relevant patents, the contents which are incorporated herein by reference, include U.S. Pat. No. 4,580,784 to Brill; U.S. Pat. No. 2,213,190 to Haverbach; U.S. Pat. No. 4,934,702 to Serizawa; and U.S. Pat. No. 6,379,259 to Opie. Nevertheless, none of these patents illustrate a golf club which enables a golfer to complete a round of golf without bending down to the ground.

SUMMARY OF THE INVENTION

In a first manifestation, the invention is a golf club head which is optimally configured to minimize or eliminate the numbers of times a golfer must bend down towards the ground. The head has a shaft coupler, and a striking face coupled thereto. A golf tee retainer is displaced from the striking face, and has a roof and a bottom opening more distal relative to the shaft coupler than the roof. The golf club head is operative to transmit forces from shaft coupler through to the roof. At least two support arms are provided having an opening therebetween, for retrieving golf balls.

In a second manifestation, the invention is, in combination, a golf club head, ball retriever, and tee handler. A first striking face is provided on the golf club head, and a ball retriever extends away from the club head isolated from the striking surface. A tee handler has means to insert and remove golf tees from the earth, and is also isolated from the striking surface.

In a third manifestation, the invention is a golf club having a head with integral ball and tee handling. A striking face terminates at a base thereof, forming a slightly arcuate junction. A tee-receiving opening is separated from the striking face and passes through the base. A narrow cross-section adjacent the base and a larger cross-section spaced from the base serve to hold the tee therein. A ball retriever extends away from the striking face and has a central opening and a rim about the central opening for operatively contacting a golf ball. A golf tee retriever extends away from the striking face and has a partial ring operative to encompass a tee and engage with a golf tee head upon application of forces axially aligned with the golf tee.

OBJECTS OF THE INVENTION

Exemplary embodiments of the present invention solve inadequacies of the prior art by providing a tee inserting feature and ball retrieving feature in combination with a golf club head.

A first object of the invention is to enable a person to complete a round of golf without bending to the ground. A second object of the invention is to provide all of the features necessary for handling balls, tees, markers and the like into a single club. Another object of the present invention is to enable these capabilities while still providing a professional-grade, balanced club. A further object of the invention is to provide additional alignment features to assist the golfer. Yet another object of the present invention is to provide the aforementioned features in a variety of club types, including putters, drivers, and any other suitable clubs.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
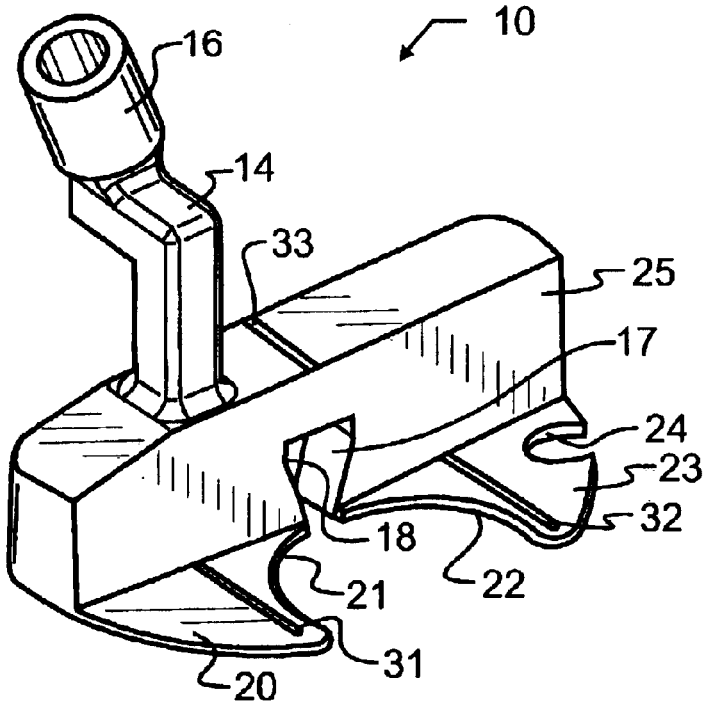
FIG. 1 illustrates a preferred embodiment golf club head designed in accord with the teachings of the present invention from projected view.

Manifested in the preferred embodiment, the present invention provides an improved golf club head which is suitable for use by anyone who, for one reason or another, is either unable or would prefer not to have to bend and reach to the ground while golfing. As illustrated in FIGS. 1–4, a putter head 10 includes a ball striking face 12 of relatively standard geometry. A slight arc 13, visible in FIG. 2, is provided along the base thereof, which accommodates the different angles with respect to the ground that different golfers will use. Opposite arc 13 with respect to striking face 12 is a shaft coupling arm 14, which terminates with shaft coupler 16. As illustrated, shaft coupler 16 is a cylindrical tube, which in turn will receive a shaft having a circular exterior therein. Both the exact geometry of shaft coupler, and the particular type and geometry of shaft received therein are not critical to the present invention, and may be adapted by those familiar with golfing and shaft construction.

Extending away and generally normal from striking face 12 are a pair of support arms 20, 23. Support arm 20 is adjacent a heel of putter head 10, while support arm 23 is adjacent the toe region. As is best visible in FIG. 3, these arms have a slight curvature 15 adjacent to the ground. This curved base 15 permits the ordinary arc of a golf swing to occur without interference from and ground contact with support arms 20, 23. The exact geometry and quantity of support arms 20, 23 is not critical to the working of the invention. However, the support arms should be displaced from the striking face to not interfere with golf swings and ball contact.

Figure 2:
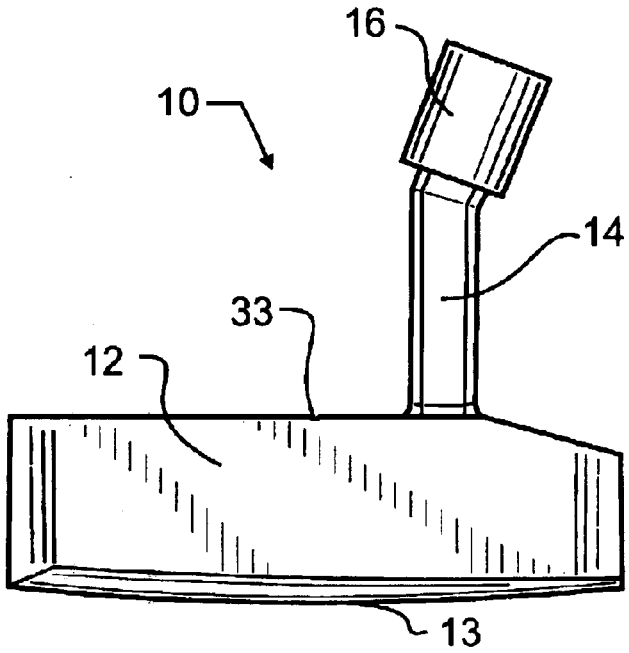
FIG. 2 illustrates the preferred embodiment golf club head of FIG. 1 from front plan view.
Figure 3:
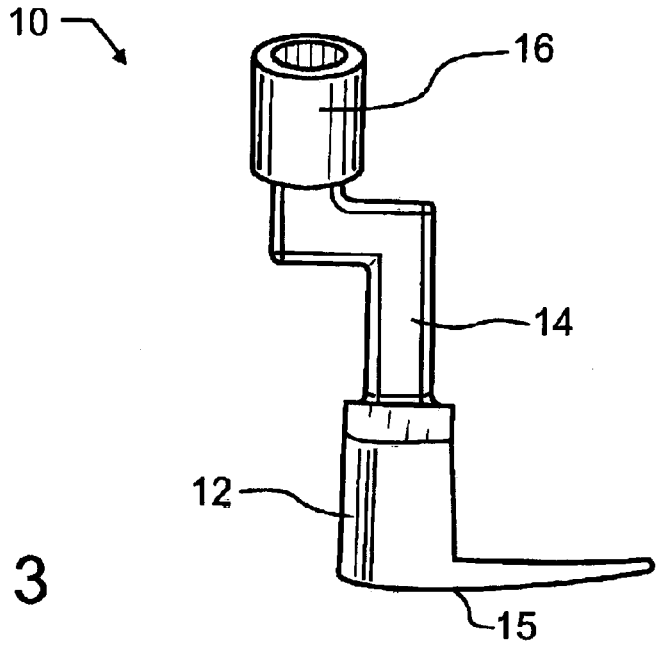
FIG. 3 illustrates the preferred embodiment golf club head of FIG. 3 from side plan view.
Figure 4:
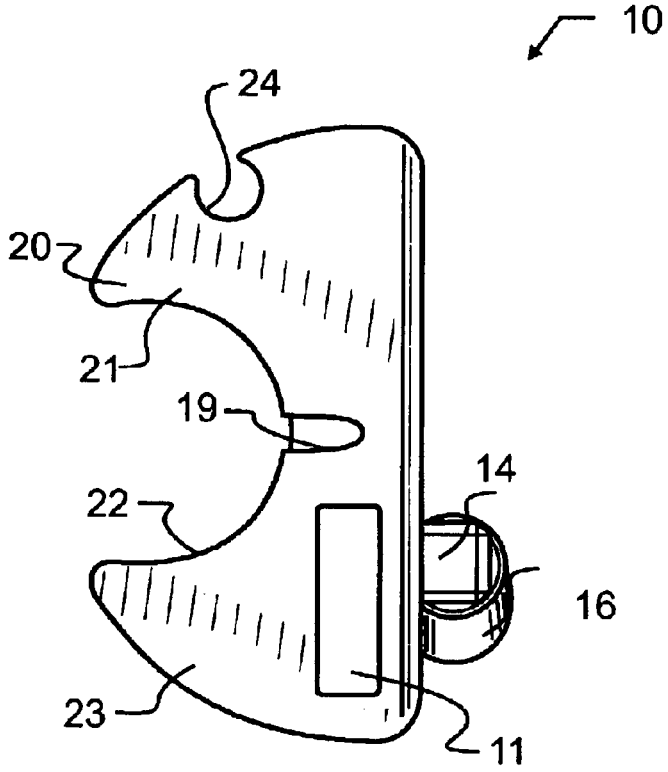
FIG. 4 illustrates the preferred embodiment golf club head of FIG. 1 from bottom plan view.

As is best visible in either FIG. 1 or 4, support arms 20, 23 have rounded arcs 21, 22, respectively that together define a generally round opening which, in the preferred embodiment putter head 10, is most preferably sized to receive a golf ball therein. Most preferably, the ball will drop into the opening, whereby gravity alone, in combination with the slightly more than hemispherical combination of arcs 21, 22, will retain the ball therein. The combined curvature in the arc 13 visible in FIG. 2 and arc 15 visible in FIG. 3 further help to support a ball therein. Consequently, as should now be apparent, the combination of arcs 21, 22 formed in support arms 20, 23 serves to receive and support a ball. The ball may be picked directly off of the ground, or, providing both putter head 10 and associated cup are sized appropriately, the ball may preferably also be scooped out of the hole cup.

Cut into putter head 10 and accessible from a surface 25 generally parallel and spaced from striking face 12 is a tee-support region 17 having a back wall 18. Most preferably, each of the faces of opening 17 and back wall 18 are tapered into the shape of the top of a golf tee. Consequently, adjacent the bottom opening 19 visible in FIG. 4, opening 17 and back wall 18 have the smallest opening cross-section. Moving away from bottom arc 13, the opening cross section increases, as best visible in FIG. 1. As is known, a golf tee widens from pointed tip to ball support surface, with a fairly fast taper adjacent the ball supporting surface. It is this fast taper adjacent the ball supporting surface that will nest into opening 17, which will permit a golf tee to be securely supported therein. A golfer will be able to slip the tee into opening 17 by moving the tee normal to surface 25. Once the tee is inserted therein, the golfer will ensure that back wall 18 is gravitationally at least slightly below and consequently supporting the tee, thereby preventing the tee from falling back out of opening 17. Similarly, the tapered, conical, or, in the case of the preferred embodiment, tetrahedral geometry within opening 17 will prevent the tee from falling down through opening 19, since opening 19 will most preferably be smaller than the cross-section of the tee adjacent to the ball support surface. The use of an opening 17 having a back wall 18 ensures that there is no interference between striking face 12 and opening 17, once again ensuring true performance of putter head 10.

While this simple geometrical configuration is most preferred for retaining a tee therein, and permitting the tee to be driven into the ground by merely pressing putter head 10 vertically downward to drive the tee into the earth, those skilled in the art will recognize that other alternative features or means may be provided to support a tee and obtain the same objectives as obtained herein by opening 17. Exemplary of one such concept, but by no means limited thereto, is the inclusion of elastomeric material which may be deformed upon insertion of a tee. The elastomer may thereby provide the necessary retaining forces. Similar alternative techniques are illustrated by Czichos, the teachings which were incorporated by reference herein above. Nevertheless, the addition of extra material or components adds to the manufactured cost of the club, and also increases the likelihood of eventual failure, such as unwanted separation between elastomer and putter head 10. As is known, the forces of impact during the striking of a ball are great, and the consequent shock and vibration will separate materials that are not well secured.

An additional circular hole 24 is visible in FIGS. 1 and 4, which is preferably dimensioned to have a diameter similar to the smallest dimension in cross-section at opening 19. This diameter, as previously described, is sufficient to allow the shaft of a golf tee to pass through, but is too small to permit the larger to of the tee to pass through. Consequently, after the tee is inserted into the ground using opening 17, back wall 18, and opening 19, and the ball is struck using striking face 13, the tee may be extracted from the ground using opening 24. This is done by sliding the tee shaft into opening 24 and then lifting, with a small gravitational tilt towards face 25, thereby supporting the tee away from falling out of opening 24. By configuring support arms 20, 23 to be of relatively thin material, even when a tee or ball is resting freely upon the ground, a simple sweeping motion will slide the arms 20, 23 under the tee or ball, and permit the appropriate opening to be used to retain the ball or tee therein.

Guide lines 31–33 will also preferably be provided, which assist the golfer with proper ball alignment during the striking thereof. These guide lines 31–33 may either be painted or marked thereon, machined from the remaining material, cast into the material, or by other suitable technique as may be desired. In preferred embodiment putter head 10, these lines are formed through small indentations directly into the surrounding material, which ensures that these guide lines 31–33 will remain as relatively permanent markings.

As is best visible in FIG. 4, an insert 11 may be provided which passes into putter head 10, and which may be used to provide the proper balancing thereof. This insert 11 may be of alternative material from the surrounding material, and will potentially have very different density therefrom. Consequently, insert 11 may be used to control the weight and weight distribution within putter head 10, and thereby properly balance the club as desired. In addition, and if desired, insert 11 may be comprised of magnetic material and may be used for the retrieval of markers.

In the preferred embodiment putter head 10, preferred material will be steel, owing to the relatively low cost, durability, case of machining, and the like. Nevertheless, many different materials may be suitable for the construction, and many different manufacturing techniques may be used. For exemplary purposes only, and not limited thereto, such manufacturing techniques as castings, and injection and other molding maybe utilized, and metals, plastics, ceramics, composites and other suitable materials may be used as desired and determined to be suitable herein.

In the most preferred embodiment, a right-handed putter head 10 is illustrated, though no limitation is intended thereby, and left-handed or even ambidextrous clubs may be fabricated based upon the teachings of the present invention provided herein. Further, while a putter is illustrated herein, it will be apparent to those skilled in the art that the features shown herein may also be provided in a driver. While perhaps of less utility, even irons may incorporate the teachings of the present invention, as may other types of golf clubs as will be apparent to those skilled in the field. While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims hereinbelow.

We claim:

1. A golf club head which is optimally configured to minimize or eliminate the numbers of times a golfer must bend down towards the ground, comprising:

a shaft coupler;

a striking face coupled to said shaft coupler;

a golf tee retainer displaced from said striking face having a roof and a bottom opening more distal relative to said shaft coupler than said roof and operative to transmit forces from said shaft coupler through said roof; and at least two support arms having an opening therebetween.

2. The golf club head of claim 1, further comprising a hole through at least one of said pair of support arms defined by an edge, said edge having a break therein such that said edge extends less than through a fill circular arc, wherein through said break a golf tee shaft may is operatively be passed into said generally round hole.

3. The golf club head of claim 2, wherein said hole through at least one of said pair of support aims is generally round, and said edge defining said hole is generally round.

4. The golf club head of claim 3, whereby said golf tee when inserted into the earth is encompassed by said generally round hole, and a head of said golf tee is held against said at least one of said at least two support arms, and said golf tee is subsequently removable from said earth thereby.

5. The golf club head of claim 1, further comprising a non-striking face spaced from said striking face, said at least two support arms extending generally normal from said non-striking face.

6. The golf club head of claim 5, further comprising a first arc of curvature at a base of said striking face from a heel of said golf club head to a toe of said golf club head.

7. The golf club head of claim 6, further comprising a second arc of curvature within said support arms from said non-striking face away therefrom.

8. The golf club head of claim 1, wherein said golf tee retainer bottom opening is smaller than said golf tee retainer roof, whereby a golf tee head will not pass through said golf tee retainer bottom.

9. The golf club head of claim 8, wherein said golf tee retainer bottom opening is spaced from said golf tee retainer roof to operatively receive a golf tee top therebetween, and said forces transmitted from said shaft coupler through said roof are further transmitted to said golf tee top, whereby said golf tee top is operatively driven into the earth by application of force upon said shaft coupler.

10. The golf club head of claim 1, wherein said opening between said at least two support arms is semi-circular.

11. The golf club head of claim 10, wherein said at least two support arms extend in a direction generally normal to said striking face and away therefrom.

12. The golf club head of claim 11, wherein said at least two support arms exhibit a slight arc along said direction generally normal to said striking face.

13. The golf club head of claim 12, wherein said at least two support arms exhibit a slight arc along a direction perpendicular to said direction generally normal to said striking face to thereby form a slightly cupped surface upon which a golf ball may rest.

14. The golf club head of claim 1, wherein said striking face is configured to be a putter.

15. A golf club having ahead with integral ball and tee handling, comprising:

a striking face terminating at a base thereof, said base having a slightly arcuate junction with said striking face;

a tee-receiving opening separated from said striking face and passing through said base having a narrow cross-section adjacent said base and a larger cross-section spaced from said base than said narrow cross-section;

a ball retriever extending away from said striking face having a central opening and a rim about said central opening for operatively contacting a golf ball; and a golf tee retriever extending away from said striking face having a partial ring operative to encompass a tee and engage with a golf tee head upon application of forces axially aligned with said golf tee.

16. The golf club of claim 15 wherein said ball retriever is slightly cup-shaped to support a ball therein when said golf club head is in a generally upright position operative to strike a ball.

17. The golf club of claim 15 wherein said golf tee retriever is formed within said ball retriever.

* * * * *